US005154598A

United States Patent [19]

Gooderham et al.

[11] Patent Number: 5,154,598

[45] Date of Patent: Oct. 13, 1992

[54] BURNER ASSEMBLIES

[75] Inventors: Alan W. Gooderham, Merrow; Stephen Warren, Shedfield, all of England

[73] Assignee: Airoil-Flaregas Limited, West Drayton, England

[21] Appl. No.: 751,664

[22] Filed: Aug. 23, 1991

Related U.S. Application Data

[63] Continuation of Ser. No. 488,064, filed as PCT/GB89/01252, Oct. 20, 1989, abandoned.

[30] Foreign Application Priority Data

Oct. 20, 1988 [GB] United Kingdom ..... 8824575

[51] Int. Cl.[5] ..... F23D 14/00

[52] U.S. Cl. ..... 431/188; 431/284; 431/348; 431/354

[58] Field of Search ..... 431/278, 281, 284, 285, 431/174, 175, 159, 181, 187, 188, 114, 10, 348, 354

[56] References Cited

U.S. PATENT DOCUMENTS

| | | | |
|---|---|---|---|
| 1,788,716 | 1/1931 | Hepburn | 431/188 |
| 1,938,851 | 12/1933 | McKee | 431/285 X |
| 1,938,852 | 12/1933 | McKee | 431/188 |
| 2,671,507 | 3/1954 | Morck, Jr. | 431/348 |
| 2,863,500 | 12/1958 | Schumann | 431/285 X |
| 2,935,128 | 5/1960 | Ferguson | 431/174 X |
| 3,180,395 | 4/1965 | Reed | 431/175 |
| 3,217,779 | 11/1965 | Reed et al. | 431/181 |
| 3,940,234 | 2/1976 | Reed et al. | 431/174 X |
| 4,095,929 | 6/1978 | McCartney | 431/188 X |
| 4,257,762 | 3/1981 | Zink et al. | 431/348 X |
| 4,505,666 | 3/1985 | Martin et al. | 431/10 X |

FOREIGN PATENT DOCUMENTS 2107848 5/1983 United Kingdom .

*Primary Examiner*—Carl D. Price

*Attorney, Agent, or Firm*—Sughrue, Mion, Zinn, Macpeak and Seas

[57] ABSTRACT

A gaseous fuel burner has a gas supply (21) feeding a burner head (10) mounted in a refractory block or tile (12) via a venturi (16). Primary combustion air is inspirated to mix with the fuel gas before passing through the venturi and is controlled by a controller (20). A further pipe branch (24) takes fuel gas directly to a further discharge means such as a series of poker nozzles (25) which inject pure gas directly into the combustion zone.

8 Claims, 1 Drawing Sheet

BURNER ASSEMBLIES

This is a continuation of application Ser. No. 07/488,064 filed as PCT/GB89/01252, Oct. 20, 1989, now abandoned.

TECHNICAL FIELD

The present invention relates to burner assemblies and more particularly to burner assemblies for use with a furnace combustion chamber.

BACKGROUND OF THE INVENTION

A known form of burner assembly has a head assembled within a refractory block forming part of a furnace wall. Fuel gas is supplied to the head and the flow of gas inspirates air to mix with the fuel gas prior to discharge from jets in the head. The air and fuel gas mixture is passed through a venturi prior to discharge. It is generally desirable to ensure that the combustion process yield low level of nitrogen-oxides (NOx) pollutants and a general object of the present invention is to provide an improved burner assembly of the aforementioned kind in which NOx emission is minimised.

DISCLOSURE OF INVENTION

In accordance with the invention, the fuel gas supplied to the burner assembly is split into two paths. One path, the main path, leads to the head and inspirates primary combustion air as in the known assembly. The other path, the secondary path, leads directly into the combustion zone without pre-mixing of combustion air. The primary air can be supplemented by a secondary air supply induced to flow around the head.

A burner assembly constructed in accordance with the invention comprises a burner head for mounting in a refractory block of a furnace wall, pipe means including a venturi connected to the head, a primary air controller for supplying primary air for combustion to said venturi of the pipe means and fuel gas supply means leading to said venturi to inspirate the primary air and create a fuel/gas air mixture for discharge from jets of the burner head and combustion; wherein the fuel gas supply means also leads to at least one further discharge means such as one or more preferably, a plurality of further discharge nozzles which inject one or more jets of pure fuel gas directly into the combustion zone. The injection of pure fuel gas produces fuel rich and fuel lean regions in the combustion zone and this is found to reduce NOx emissions.

The pipe means leading to the burner head conveniently extends through an aperture in the refractory block and a secondary air supply controller may be provided to allow secondary air to be induced to flow through the aperture to the combustion zone. Where the further gas discharge means is a plurality of nozzles, these further nozzles can be supplied via pipes also extending through the aperture. The pipe means may include a guide and mixture unit in which primary air and fuel gas meet prior to passing through the venturi. Preferably, the discharge nozzles lie nearer the refractory block and preferably upstream of the discharge of the jets of the burner head. The gas nozzles can take the form of pokers connected with pipes leading through the aperture in the refractory block to a common manifold. Branch pipes then join the manifold and the mixture unit to a main pipe serving as the gas supply.

In another design the further gas discharge means is in the form of a hollow cylindrical structure leading through the aperture.

A silencer is preferably incorporated in the assembly to reduce noise.

The invention may be understood more readily, and various other features of the invention may become apparent, from consideration of the following description.

BRIEF DESCRIPTION OF DRAWINGS

An embodiment of the invention will now be described, by way of example, only with reference to the accompanying drawing in which.

BEST MODE OF CARRYING OUT THE INVENTION

Figure 1:
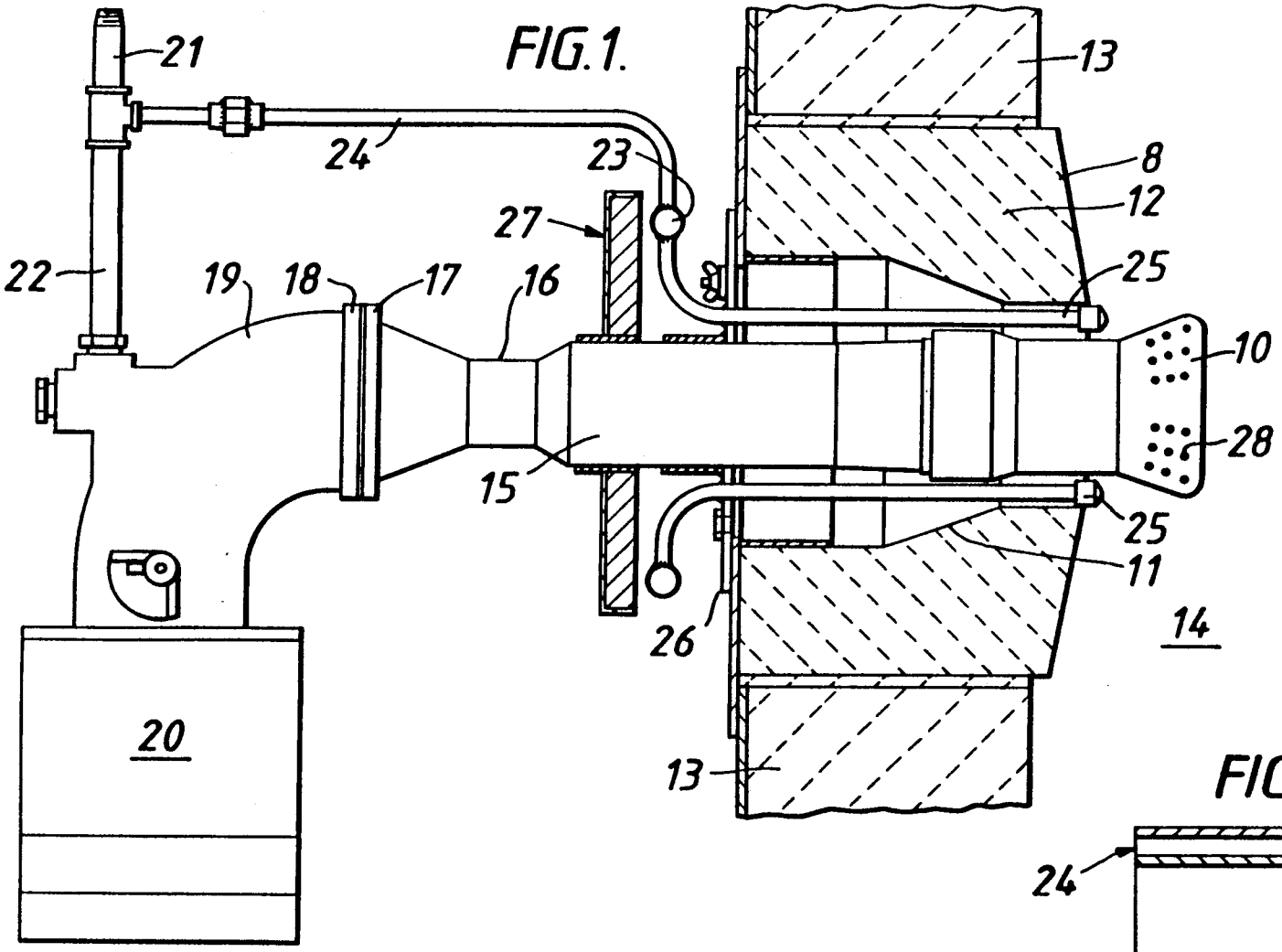
FIG. 1 is a schematic part-sectional side view of a burner assembly constructed in accordance with the invention and FIG. 2 is a sectional side view depicting an alternative fuel gas discharge means.

As shown in FIG. 1 of the drawing, a burner assembly is composed of a head 10 mounted in an aperature 11 in a refractory block 12 in a lined wall 13 of a combustion chamber 14. The face 8 of the block 12 is intended to radiate heat into the chamber 14. The head 10 is connected via a tubular pipe 15 to a venturi 16. The venturi 16 is coupled via inter-engageable flanges 17,18 to an air/fuel gas guide and mixture unit 19. The unit 19 is connected to a primary air controller 20. Fuel gas is supplied to the burner assembly via an inlet pipe 21 which feeds the unit 19 via a pipe 22 and also feeds a manifold 23 via a pipe 24. The manifold 23 in turn feeds one or a plurality of poker nozzles 25 distributed around the head 10. Any number of nozzles 25 can be provided but typically there are three to six nozzles 25 disposed symmetrically or asymmetrically around the head 10. An adjustable secondary air controller 26 is mounted at the rear of the block 12 to control secondary air passing into the aperture 11. A further plate structure 27 acting as a silencer is mounted on the pipe 15.

During use, gas is supplied to the burner via the inlet pipe 21 and a portion of the gas flows through the pipe 22 to enter the mixture unit 19. The flow of gas through the mixer unit 19 and venturi 16 inspirates air via the primary air controller 20. The air and fuel gas mix as they pass through the venturi 16 and the venturi 16 compresses the mixture which then discharges from a large number of jets 28 in the head 10.

The remaining portion of the gas which flows through the pipe 24 is distributed by the manifold 23 to the poker nozzles 25 and injected directly into the combustion zone. The air/gas mixture is ignited by a suitable device such as a pilot burner (not shown) and the resulting flame tends to cling to the face 8 of the block 12. This face 8 then radiates heat into the chamber 14. The air necessary to support combustion is supplemented by secondary air admitted by the controller 26 to pass through the aperture 11. This secondary air is drawn into the combustion zone by natural or induced draught caused by lower pressure in the chamber 14. The gas discharged by the nozzles 25 is directed into the flame without pre-mixing with air.

Figure 2:
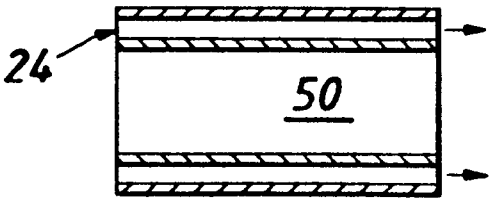

In another design depicted in FIG. 2 the pipe 24 leads to the interior of a double walled hollow cylinder 50 which extends through the aperture 11 and emits the fuel gas as an annulus.

The operation of the burner assembly is controlled so that the main fuel gas/air mixture contains an excess quantity of air i.e. is air rich which tends to reduce the temperature of the flame. In addition fuel gas passed into the flame by the poker nozzles 25 or the equivalent annulus enters into a region already low in oxygen due to partial combustion. This produces fuel rich and fuel lean zones which also reduces the temperature of the flame. This overall effect is to create lower NOx emissions.

We claim:

1. A burner assembly comprising a burner head mounted in an aperture in a refractory block in a furnace wall; emission jets in the head for discharging a fuel gas/air mixture into a combustion zone in the furnace in a direction to create a heat radiating surface on an internal wall of the refractory block; pipe means having an inlet end and including a venturi, connected to the head; a primary air controller for controlling the supply of primary air for combustion to said pipe means; fuel gas supply means leading to said pipe means to supply fuel gas and to inspirate primary air to flow from the air controller through the venturi and the pipe means to create the fuel gas/air mixture which flows along the pipe means and discharges from the jets of the burner head for combustion in the combustion zone in the furnace, and gas discharge means connected directly to the fuel gas supply means to inject one or more jets of said fuel gas without air directly into the combustion zone from a location closely proximate the head radiating surface of the refractory block wall and spaced from the discharge jets of the burner head in the direction of the inlet end to create fuel rich and fuel lean regions in the combustion zone to reduce NOx emissions.

2. An assembly according to claim 1 wherein the gas discharge means is a hollow cylindrical structure.

3. An assembly according to claim 1 wherein the gas discharge means is a plurality of separate discharge nozzles.

4. An assembly according to claim 1 wherein the pipe means includes a guide and mixture unit in which primary air and fuel gas are mixed prior to passing through the venturi.

5. An assembly according to claim 1 wherein the gas discharge means is a plurality of separate discharge nozzles connected to a manifold which is connected via a pipe to the fuel gas supply means, and the guide and mixture unit is connected via another pipe to the fuel gas supply means.

6. An assembly according to claim 1 and further comprising a secondary air supply controller which serves to allow secondary air to be induced to flow through the aperture to the combustion zone.

7. An assembly according to claim 1 and further comprising a plate structure serving as a silencer mounted to the pipe means.

8. An assembly according to claim 1 wherein said location at which said one or more jets of fuel gas are emitted into the combustion zone is upstream from the discharge jets of the burner head.

* * * * *